United States Patent [19]

Hamon

[11] 4,337,624

[45] Jul. 6, 1982

[54] CRYOSTATIC DEVICE

[75] Inventor: Christian H. Hamon, Saint-Maur, France

[73] Assignee: Societe Anonyme de Telecommunications, Paris, France

[21] Appl. No.: 160,483

[22] Filed: Jun. 18, 1980

[30] Foreign Application Priority Data

Jun. 29, 1979 [FR] France ..... 79 16840

[51] Int. Cl.[3] ..... B65D 25/04; B65D 25/18; B65D 90/04; F17C 13/00

[52] U.S. Cl. ..... 62/45; 137/576; 220/420; 220/425; 220/901

[58] Field of Search ..... 62/45, 54, 55; 244/135 R; 220/901, 420, 425, 426, 421, 422, 423, 424; 137/264, 574, 576, 210

[56] References Cited

U.S. PATENT DOCUMENTS

| | | | |
|---|---|---|---|
| 662,217 | 11/1900 | Brady | 220/426 |
| 1,535,642 | 4/1925 | Armknecht | 137/264 X |
| 1,561,102 | 11/1925 | Mott | 220/425 |
| 1,998,629 | 4/1935 | Lagarde | 220/426 X |
| 2,293,263 | 8/1942 | Kornemann et al. | 137/264 X |
| 2,389,168 | 11/1945 | Snyder | 137/576 X |
| 2,643,022 | 6/1953 | Cornell | 220/424 |
| 2,719,583 | 10/1955 | Malick | 137/264 X |
| 2,845,199 | 7/1958 | Putman et al. | 220/901 X |
| 3,144,756 | 8/1964 | Arnold et al. | 62/55 |

FOREIGN PATENT DOCUMENTS

| | | | |
|---|---|---|---|
| 96584 | 10/1963 | Denmark | 220/426 |
| 1237018 | 10/1958 | France | 220/901 |
| 634069 | 11/1978 | U.S.S.R. | 62/45 |

*Primary Examiner*—Allan N. Shoap
*Attorney, Agent, or Firm*—Holman & Stern

[57] ABSTRACT

A cryostatic device comprising an inner wall and an outer wall connected at their upper parts by a filling orifice, a vacuum being made between the two walls, wherein the tank of cryogenic liquid, which is defined by the inner wall, is divided by a separating partition into two tanks, a primary tank and a secondary tank, the secondary tank surrounding all or part of the primary tank, the filling orifice opening into the secondary tank, and the primary tank and the secondary tank communicating via an orifice located in the separating partition at a level such that the volume of the primary tank located below said orifice is approximately equal to the volume located above this same orifice in this same tank.

10 Claims, 5 Drawing Figures

CRYOSTATIC DEVICE

BACKGROUND OF THE INVENTION

The present invention relates to a cryostatic device adapted to be placed on board a vehicle capable of undergoing considerable accelerations in several directions. Such devices are essentially composed of a tank which is filled with a cryogenic liquid, liquid air, liquid nitrogen or the like, prior to the departure of the vehicle, which may be a pilotless aircraft or drone. The tank, after having undergone the accelerations during take-off and modifications of the path of said vehicle, must still contain enough cryogenic liquid to allow it to remain operational for the time provided.

Known cryostatic devices are in the form of a double-walled tank with a filling orifice at the top. It will be readily appreciated that this simple cryostatic device, such as a bottle, placed in a vehicle, is emptied through its upper orifice if the vehicle is subjected to a considerable downwardly vertical acceleration referred to as positive since it is in the same direction as gravity. An acceleration which is greater than that of gravity is considerable in this regard.

To obviate this drawback, an immersed tube, effectively extending the filling orifice to about the middle of the tank, has been used to reduce the volume of cryogenic liquid ejected through the filling orifice when considerable vertical positive acceleration is experienced. However, this improvement is not entirely satisfactory because too much cryostatic liquid is still ejected.

SUMMARY OF THE INVENTION

To overcome this drawback, the cryostatic device according to the invention, which comprises an inner wall and an outer wall connected at their upper parts by the filling orifice, a vacuum being created between the two walls, is characterized in that the tank of cryogenic liquid, which is defined by the inner wall, is divided by a separating partition into two tanks, a namely primary tank and a secondary tank. The secondary tank surrounds all or part of the primary tank, the filling orifice opens into the secondary tank, and the primary tank and the secondary tank communicate via an orifice located in the separating partition at a level such that the volume of the primary tank located below said orifice is approximately equal to the volume located above this same orifice in this same tank.

If the primary tank is cylindrical in form, said communicating orifice is then located approximately half way up said primary tank.

Still according to the invention, the cryostatic device will advantageously comprise one or more capillary conduits in the upper part of the lateral portion of the separating partition. The capillary conduits are located approximately above the communicating orifice, for example, in the case of a cylindrical primary tank, on the same generatrix or on adjacent generatrices. Thus, the cryostatic device according to the invention will have a poorer behaviour only for the accelerations along the same axis as the displacement of the drone, but in opposite direction to this displacement; in practice, this type of acceleration is rarely encountered.

According to a further feature of the invention, the orifice communicating between the primary tank and the secondary tank will advantageously be protected by a deflector located inside said primary tank.

The main advantage of the cryostatic device according to the invention resides in that the cryostatic liquid is held to a maximum inside said cryostatic device despite the accelerations to which it may be subjected in various directions. Tests made on a cryostatic device according to the invention, placed on board a drone, have shown that a quantity of cryostatic liquid equivalent to half the contents of the primary tank remained inside the device whatever the number, intensity and direction of said accelerations, it being understood that the accelerations along the same axis as the displacement of the drone and of opposite direction are statistically small in number during a flight.

A further advantage of the cryostatic device according to the invention resides in the fact that the secondary tank, which surrounds the primary tank partially or almost totally, has an additional role of cooling the walls of the primary tank to reduce the evaporation of the cryostatic liquid in contact therewith.

BRIEF DESCRIPTION OF THE DRAWINGS

The invention will be more readily understood on reading the following description with reference to the accompanying drawings, in which.

DESCRIPTION OF THE PREFERRED EMBODIMENT

Figure 1:
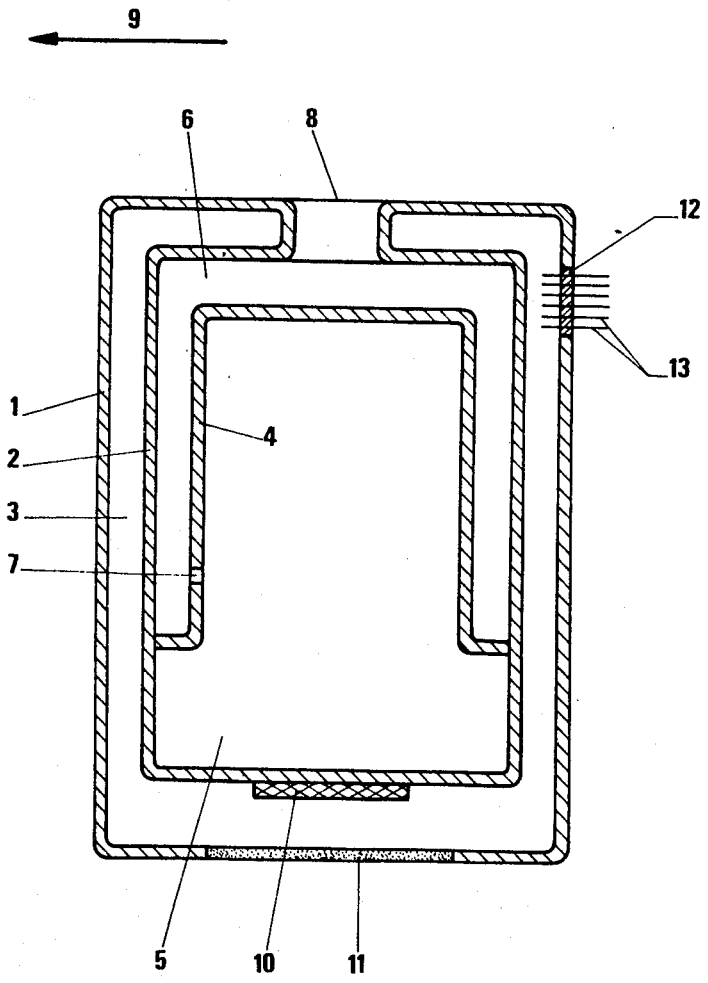
FIGS. 1 and 2 show two embodiments of the cryostatic device according to the invention.

Referring now to the drawings, FIG. 1 shows, at 1, the outer wall of the cryostatic device according to the invention and, at 2, the inner wall of this same device. Vacuum is established at 3 between these two walls 1 and 2 using conventional techniques. According to the invention, a separating partition 4 divides the tank of cryostatic liquid defined by the inner wall 2, into two tanks, the primary tank 5 and secondary tank 6. An orifice 7 formed in the partition 4 approximately half way up the primary tank 5 provides communication between said primary tank 5 and the secondary tank 6, the latter being extended by the filling orifice 8.

The device shown by way of example in FIG. 1 is cylindrical in form and FIG. 1 shows a section along two diametrically opposed generatrices of this device. No ratio is imposed between the height and the diameter of said cryostatic device. When said cryostatic device is placed on board a drone, it is placed in vertical position the filling orifice 8 being at the top, and the communicating orifice 7 facing towards the front of the drone. The normal direction of displacement of the drone is represented by arrow 9. The communicating orifice 7 must remain small with respect to the height of the primary tank 5 and it is of circular or oval cross section.

The diameter of the filling orifice 8 has been limited in the present case to reduce losses by conduction. Its exact position may be chosen in accordance with the characteristics of the accelerations undergone in use and possibly of the strength of the materials used.

Of course, the cryostatic device according to the invention may comprise all the fixtures necessary for use thereof, which are well known. Thus, various elements 10 to be cooled may be fixed on the inner wall 2 and in the evacuated chamber 3; in the outer wall 1, there may be included a zone 11 transparent to certain radiations and a vacuum-tight element 12 bearing electrical leads 13.

By way of example, the walls 1 and 2 and the partition 4 may be made of glass, but it is obvious that metal, for example a copper alloy or stainless steel, may be used without departing from the scope of the invention. In the case of glass being used, the walls will advantageously be metallized, according to known techniques, to reduce heat losses by radiation.

Figure 2:
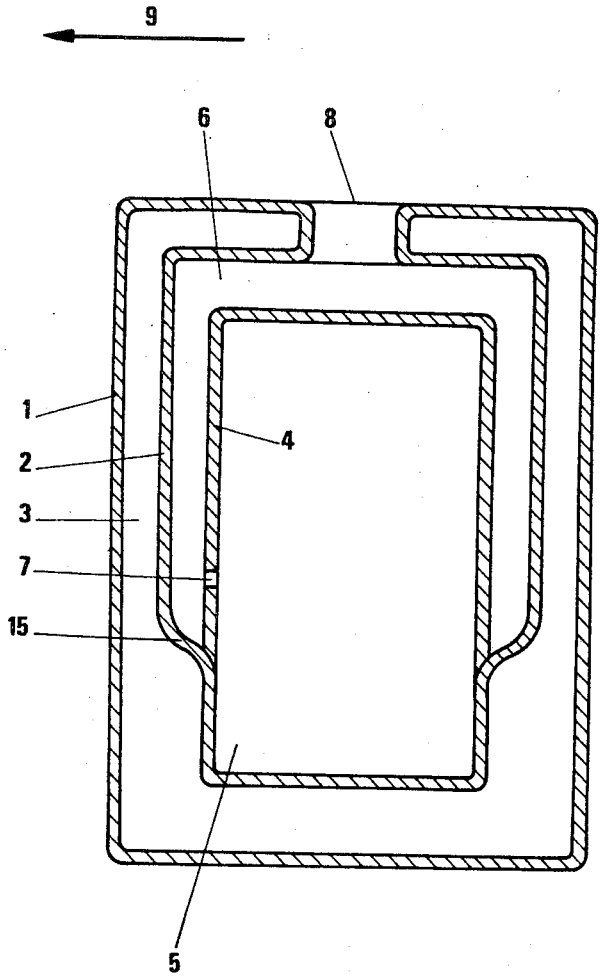

FIG. 2 is also a sectional view through a cryostatic device according to the invention. For reasons of technological convenience, the inner wall 2 of this cryostatic device is provided with a shoulder 15 at whose base the partition 4 is fixed. In all the Figures accompanying the present specification, the same elements of the different embodiments of the device according to the invention are given the same reference numerals.

Figure 3:
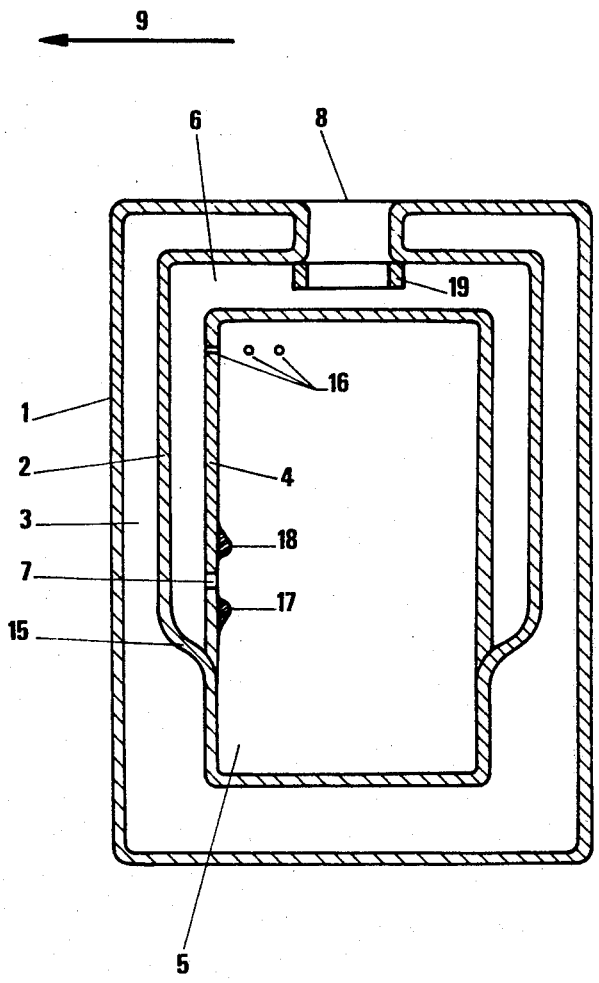
FIGS. 3 and 4 are each section views through a cryostatic device according to the invention provided with various improvements.

FIG. 3 shows some improvements to the cryostatic device according to the invention. Depending on the applications, these improvements may be used independently of one another or simultaneously. The first of said improvements consists in one or more capillary conduits 16 connecting the primary tank 5 to the secondary tank 6, said capillary holes 16 being located in the upper part of the separating partition 4. The purpose of said capillary holes 16 is to facilitate the filling of the primary tank 5; in particular they enable the primary tank 5 to be almost completely filled, whilst, in their absence, the level of filling is limited to the level of the communicating orifice 7.

A second improvement of the cryostatic device according to the invention resides in securing a deflector 17 in the vicinity of the communicating orifice 7. This deflector is located inside the primary tank 5 and below the communicating orifice 7. When the cryogenic liquid contained in the lower part of the primary tank 5 is projected, under the influence of an acceleration, towards the top of this same tank, the presence of the deflector 17 considerably reduces the quantity of cryogenic liquid ejected through the orifice 7. A second deflector 18 may also be provided, also located inside the primary tank 5, but above the communicating orifice 7.

A third improvement of the cryostatic device according to the invention consists in extension 19, inside the secondary tank 6, of the filling orifice 8. The purpose of this extension 19 is to retain, to a maximum extent, the cryogenic liquid located in the secondary tank 6 inside the cryostatic device according to the invention.

Figure 4:
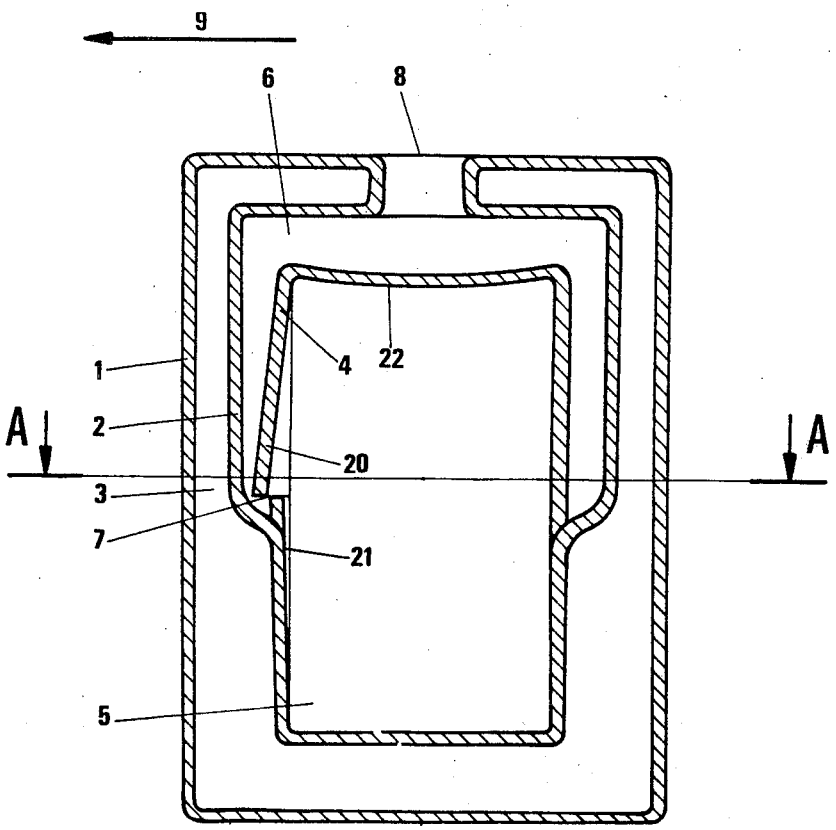
Figure 5:
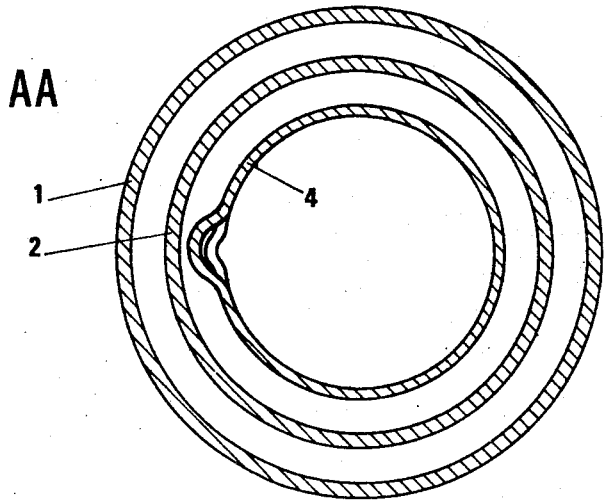
FIG. 5 shows a section at right angles with respect to the preceding ones through a cryostatic device provided with an improvement for facilitating draining.

FIG. 4 shows two further improvements which may be made to the cryostatic device according to the invention. Firstly, to facilitate the operation of draining the cryostatic device, a certain inclination may be given to the walls of the primary tank at 20 and 21 to facilitate the voluntary flow of the cryostatic liquid or of an undesirable condensation liquid. FIG. 5 is a section along line A—A of the cryostatic device shown in FIG. 4, this FIG. 5 showing the form of the inclinations 20 and 21.

It should be noted that it is unnecessary to make the improvement concerning the inclinations 20 and 21 and the improvement concerning the extension 19 of the filling orifice 8, to the same cryostatic device.

FIG. 4 shows another possible improvement of the cryostatic device according to the invention. This improvement resides in that the upper part of the separating partition 4 has a slight concavity 22 oriented to form a dish under the filling orifice 8 so that, as from the beginning of filling, a certain quantity of cryogenic liquid accumulates in said dish and improves the conditions of cooling of the cryostatic device according to the invention.

It is recalled that the cryostatic devices described hereinabove and shown in the drawings are given only by way of example. In particular, the use of cylindrical volumes is in no way critical and, according to the various requirements, volumes of square, rectangular, oval or other sections may be used.

The main use of the cryostatic device according to the invention is obviously the conservation of cryogenic liquid on board vehicles subjected to strong accelerations.

It is obvious that said cryostatic device may also be adapted to transporting any liquid on board a vehicle subjected to strong accelerations. In the latter case, the outer wall 1 of said device may be eliminated.

What is claimed is:

1. A cryostatic device comprising an inner wall and an outer wall connected at their upper parts by a filling orifice, a vacuum being made between the two walls, wherein a tank for cryogenic liquid, which is defined by the inner wall, is divided by a separating partition into two tanks, a primary tank and a secondary tank, the secondary tank surrounding at least a part of the primary tank, the filling orifice opening into the secondary tank from above the primary tank, and the primary tank and the secondary tank communicating via a communicating opening located in the separating partition at a level such that the volume of the primary tank located below said communicating opening is approximately equal to the volume located above said communicating opening in said primary tank, wherein said partition includes a generally horizontally-extending portion disposed directly below said filling orifice and a generally vertically-extending portion extending downward from said horizontally-extending portion, and wherein said inner wall includes:

a first portion extending substantially parallel to the vertically-extending portion of said partition;

a second portion which tapers from said first portion to join said partition at a vertical location disposed below said communicating opening; and a third portion defining the bottom of said primary tank.

2. A cryostatic device as claimed in claim 1, comprising at least one capillary opening in the upper part of the lateral portion of the separating partition approximately above the communicating opening between the primary and secondary tanks.

3. A cryostatic device as claimed in one of claims 1 or 2, wherein the communicating opening between the primary tank and the secondary tank is protected by a deflector located inside said primary tank.

4. A cryostatic device as claimed in one of claims 1 or 2, wherein the filling orifice extends inside the secondary tank.

5. A cryostatic device as claimed in claim 1, wherein said generally vertically-extending portion of said partition includes an outwardly-extending bulge which converges toward said inner wall and has a downwardly-facing slot defined therein to constitute said communicating opening.

6. A cryostatic device comprising an inner wall and an outer wall connected at their upper parts by a filling orifice, a vacuum being made between the two walls, wherein the tank of cryogenic liquid, which is defined by the inner wall, is divided by a separating partition into two tanks, a primary tank and a secondary tank, the secondary tank surrounding at least a part of the primary tank, the filling orifice opening into the secondary tank, and the primary tank and the secondary tank communicating via a communicating orifice located in the separating partition at a level such that the volume of the primary tank located below said communicating orifice is approximately equal to the volume located above said communicating orifice in said primary tank, wherein the upper part of the separating partition has a concavity forming a dish below the filling orifice.

7. A cryostatic device comprising:

inner and outer walls defining an evacuated space therebetween, said inner wall further defining a tank for cryogenic liquid;

a separating partition dividing said tank into primary and secondary chambers, the secondary chamber surrounding at least part of said primary chamber;

a cryogenic liquid filling orifice extending through said inner and outer walls proximate their uppermost parts to permit said secondary chamber to receive cryogenic liquid directly from said filling orifice; and means for maintaining cryogenic liquid in said primary chamber at at least a predetermined level with cryogenic liquid from said secondary chamber, said means comprising a communicating orifice defined through said separating partition at said predetermined level in said primary tank;

wherein said partition includes a generally horizontally-extending portion disposed directly below said filling orifice and a generally vertically-extending portion extending downward from said horizontally-extending portion; and wherein said inner wall includes a first portion extending substantially parallel to the vertically-extending portion of said partition, a second portion which tapers from said first portion to join said partition at a vertical location disposed below said communicating orifice, and a third portion defining the bottom of said primary tank.

8. A cryostatic device as claimed in claim 7, comprising at least one capillary opening defined through said separating partition at a level in said primary chamber above said predetermined level to provide flow communication between said primary and secondary chambers.

9. A cryostatic device as recited in claim 7, further comprising deflector means, in the form of a projection from said separating partition into said primary chamber at a location proximate said communicating orifice, for deflecting flow of cryogenic liquid away from said communicating orifice when flowing along said separating partition.

10. A cryostatic device comprising:

inner and outer walls defining an evacuated space therebetween, said inner wall further defining a tank for cryogenic liquid;

a separating partition dividing said tank into primary and secondary chambers, the secondary chamber surrounding at least part of said primary chamber;

a cryogenic liquid filling orifice extending through said inner and outer walls proximate their uppermost parts to permit said secondary chamber to receive cryogenic liquid directly from said filling orifice; and means for maintaining cryogenic liquid in said primary chamber at at least a predetermined level with cryogenic liquid from said secondary chamber, said means comprising a communicating orifice defined through said separating partition at said predetermined level in said primary tank;

wherein said separating partition has an upper portion having a concave configuration forming a dish positioned directly below said filling orifice.

* * * * *